US008876177B2

(12) United States Patent
Takada et al.

(10) Patent No.: US 8,876,177 B2
(45) Date of Patent: Nov. 4, 2014

(54) HANDLE SYSTEM

(75) Inventors: Ryo Takada, Kanagawa (JP); Hitoshi Miyamae, Kanagawa (JP); Hiroaki Fukunaga, Aichi (JP); Yasuyuki Saito, Aichi (JP)

(73) Assignees: Piolax Inc, Yokohama-Shi, Kanagawa (JP); Hayashi Telempu Co., Ltd., Nagoya-Shi, Aichi (JP)

( * ) Notice: Subject to any disclaimer, the term of this patent is extended or adjusted under 35 U.S.C. 154(b) by 191 days.

(21) Appl. No.: 13/137,848

(22) Filed: Sep. 16, 2011

(65) Prior Publication Data

US 2012/0068482 A1 Mar. 22, 2012

(30) Foreign Application Priority Data

Sep. 17, 2010 (JP) ..... 2010-210219

(51) Int. Cl.

| | |
|---|---|
| ***E05B 63/20*** | (2006.01) |
| ***E05C 1/14*** | (2006.01) |
| *E05B 15/10* | (2006.01) |
| *E05B 17/00* | (2006.01) |
| *E05B 77/00* | (2014.01) |

(52) U.S. Cl.

CPC ..... *E05C 1/145* (2013.01); *E05B 15/10* (2013.01); *E05B 17/0004* (2013.01); *E05B 77/00* (2013.01); *Y10S 292/31* (2013.01)

USPC ... 292/336.3; 292/34; 292/170; 292/DIG. 31; 70/208

(58) Field of Classification Search

USPC ..... 292/175, 163, 169, 140, 143, 145, 146, 292/173, DIG. 31, DIG. 38, 336.3, 80, 81, 292/DIG. 20, DIG. 47; 403/329, 317

See application file for complete search history.

(56) References Cited

U.S. PATENT DOCUMENTS

| | | | | |
|---|---|---|---|---|
| 4,791,756 | A * | 12/1988 | Simpson | 49/175 |
| 6,109,669 | A | 8/2000 | Pinkow | |
| 6,152,501 | A * | 11/2000 | Magi et al. | 292/336.3 |
| 6,305,725 | B1 * | 10/2001 | Antonucci et al. | 292/67 |
| 6,626,472 | B1 * | 9/2003 | Berg | 292/336.3 |
| 6,719,332 | B2 | 4/2004 | Sekulovic | |
| 7,083,205 | B2 | 8/2006 | Hall | |
| 7,144,181 | B2 * | 12/2006 | Areh et al. | 403/109.3 |
| 7,182,374 | B2 * | 2/2007 | Figge et al. | 292/334 |

(Continued)

FOREIGN PATENT DOCUMENTS

| | | |
|---|---|---|
| JP | 2009-160957 A | 7/2009 |
| JP | 2010-120584 A | 6/2010 |

*Primary Examiner* — Kristina Fulton
*Assistant Examiner* — Thomas Neubauer
(74) *Attorney, Agent, or Firm* — McGinn IP Law Group, PLLC

(57) ABSTRACT

According to one embodiment, there is provided a handle system including; a main body mounted to a mounting hole in a board; an operating member supported rotatably on the main body; a lock member locks/unlocks the board with a lock receiver in a vehicle's luggage compartment; and a cover adapted to a back surface of the main body, wherein the main body has a pair of side walls in which a pair of shaft holes are formed, a base portion positioned between the side walls, and a pair of elastic claws provided on the base portion to movably hold the lock member therebetween, wherein the operating member has a pair of projecting shafts which are inserted into the pair of shaft holes, and wherein the cover has opening suppressing portions which suppress an opening movement of the elastic claws.

7 Claims, 11 Drawing Sheets

(56) References Cited

U.S. PATENT DOCUMENTS

| | | | | |
|---|---|---|---|---|
| 7,399,009 | B2 * | 7/2008 | Hall et al. | 292/100 |
| 7,644,963 | B2 * | 1/2010 | Fan et al. | 292/95 |
| 8,001,725 | B2 * | 8/2011 | Lhotak | 49/199 |
| 8,727,393 | B2 * | 5/2014 | Ruspil | 292/163 |
| 2004/0151539 | A1 * | 8/2004 | Sikora et al. | 403/329 |
| 2007/0120376 | A1 * | 5/2007 | Bella | 292/163 |
| 2008/0018116 | A1 * | 1/2008 | Helton et al. | 292/173 |
| 2008/0169657 | A1 * | 7/2008 | Horton et al. | 292/220 |
| 2008/0179896 | A1 * | 7/2008 | Chung | 292/164 |
| 2009/0096221 | A1 * | 4/2009 | Jan et al. | 292/81 |
| 2012/0248793 | A1 * | 10/2012 | Fiedler | 292/163 |

* cited by examiner

HANDLE SYSTEM

CROSS-REFERENCE TO RELATED APPLICATION(S)

This application claims priorities from Japanese Patent Application No. 2010-210219 filed on Sep. 17, 2010, the entire contents of which are incorporated herein by reference.

FIELD

The present invention relates to a handle system including a lock mechanism.

BACKGROUND

Generally, a vehicle has a luggage compartment provided in a rear portion thereof. A storage compartment is provided under the luggage compartment for storing a spare tire and small articles. And, a flat board is placed in the luggage compartment as a lid for the storage compartment and as a floor of the luggage compartment. This board is locked to the vehicle's body so as not to be opened or shifted laterally due to the vibration of the vehicle.

Handle systems for a board placed in a vehicle are disclosed in, for example, JP-2009-160957-A, U.S. Pat. No. 6,109,669-B, U.S. Pat. No. 6,626,472-B, U.S. Pat. No. 6,719,332-B and U.S. Pat. No. 7,083,205-B. Such handle system has a body, a handle connected rotatably to the body and a lock member adapted to move forwards and backwards as the handle rotates, and the lock member is caused to move backwards so as to unlock the board in accordance with a rotation of the handle.

In JP-2009-160957-A, shaft receiving holes in the body and the handle are disposed coaxially, and a rod-like shaft is inserted into the shaft receiving holes, whereby the body and the handle are connected together. In each of U.S. Pat. No. 6,109,669-B, U.S. Pat. No. 6,626,472-B, U.S. Pat. No. 6,719,332-B and U.S. Pat. No. 7,083,205-B, shaft portions which are formed integrally on the handle are inserted into shaft receiving holes in the body, whereby the body and the handle are connected together.

JP-2010-120584-A discloses a handle system for a board placed in a vehicle having a body and a handle connected rotatably to the body.

In JP-2009-160957-A, the shaft is made of a metal, which increases the production costs. And, the assembling work of inserting the rod-like shaft into the shaft receiving holes in the body and the shaft receiving holes in the handle is troublesome.

In each of U.S. Pat. No. 6,109,669-B, U.S. Pat. No. 6,626,472-B, U.S. Pat. No. 6,719,332-B and U.S. Pat. No. 7,083,205-B, the shaft portions are formed integrally on the handle, and the assembling work is performed by inserting the shaft portions into the shaft receiving holes in the body from a front surface side of the body. When these handle systems are used, that is, when the handle is pulled up by the hand, the shaft portions of the handle are pulled from the shaft receiving holes towards the front surface side. Namely, the shaft portions of the handle are pulled so as to reversely follow the path drawn by the shaft portions at the time of inserting the shaft portions into the body, and therefore, the shaft portions may be pulled out of the shaft receiving portions. Alternatively, if the shaft receiving holes and the peripheries thereof are configured so that the shaft portions of the handle hardly come out of the shaft receiving holes, a large force is required to insert the shaft portions into the shaft receiving holes at the time of assemblage, which deteriorates the working efficiency.

The large force is applied to the handle when the vehicle board is lifted up, and therefore, it is important to prevent the handle from being removed from the body. In order to prove a handle which is easily assembled to but is hardly removed from a body, JP-2010-120584-A proposes to assemble a handle to a body by being inserted from a back side of a base member via a cutout opening formed in the base member. However, in this construction, a lock member cannot be supported on the base member.

SUMMARY

One object of the present invention is to provide a handle system having a lock mechanism to prevent an operating member from being removed from a main body while enabling the easy assemblage of the operating member.

According to one embodiment, there is provided a handle system which is mounted in a board which is placed in a vehicle's luggage compartment, the handle system including; a main body which is mounted to a mounting hole in the board; an operating member which is supported rotatably on the main body so as to be operated from a front surface side of the main body; a lock member which locks the board to a lock receiver in the luggage compartment and which unlocks the board from the lock receive when the operating member is rotated; and a cover which is adapted to cover a back surface side of the main body, wherein the main body has a pair of side walls in which a pair of shaft holes are formed, respectively, a base portion which is positioned between the side walls, a pair of elastic claws which are provided on the base portion to movably hold the lock member therebetween, a front edge which connects the side walls, and a through hole which is disposed between the base portion and the front edge, wherein the operating member has a pair of projecting shafts which are inserted into the pair of shaft holes, respectively, and wherein the cover has opening suppressing portions which suppress a movement of the elastic claws in an opening direction.

According to the above configuration, the operating member can be assembled to the main body by being inserted into the through hole from a back side of the main body. When the cover is attached to a back surface of the main body after the operating member has been assembled to the main body, the opening suppressing portion suppresses the movement of the elastic claws. Thus, the holding of the lock member by the elastic claws can be prevented from being released.

According to the present invention, there is provided the handle system having the lock mechanism which prevents the removal of the operating member from the main body while facilitating the assemblage of the operating member.

DETAILED DESCRIPTION

Figure 1:
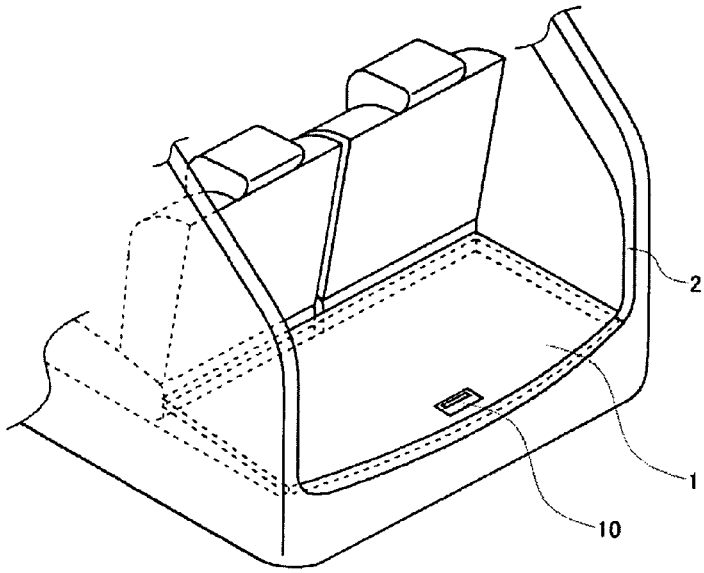
FIG. 1 illustrates a state in which a board according to an embodiment is mounted in a vehicle.

FIG. 1 illustrates a state in which a board 1 according to an embodiment is mounted in a vehicle. Generally, a vehicle has a luggage compartment at a rear portion. And, at rear of the luggage compartment, a rear opening 2 which is opened and closed by a tail gate is formed. For example, luggage is loaded into and unloaded from the luggage compartment through the rear opening 2. The board 1 is placed in the luggage compartment, and a storage box is provided underneath the board 1.

A handle system 10 according to the embodiment has a lock mechanism to fix the board 1 so as not to be opened or shifted due to the vibration, when the vehicle is driven. The handle system 10 fixes the board 1 to a lock receiver (not shown) of the vehicle. The board 1 is placed in the luggage compartment and has a mounting hole (not shown) in which the handle system 10 is to be mounted.

Figure 2:
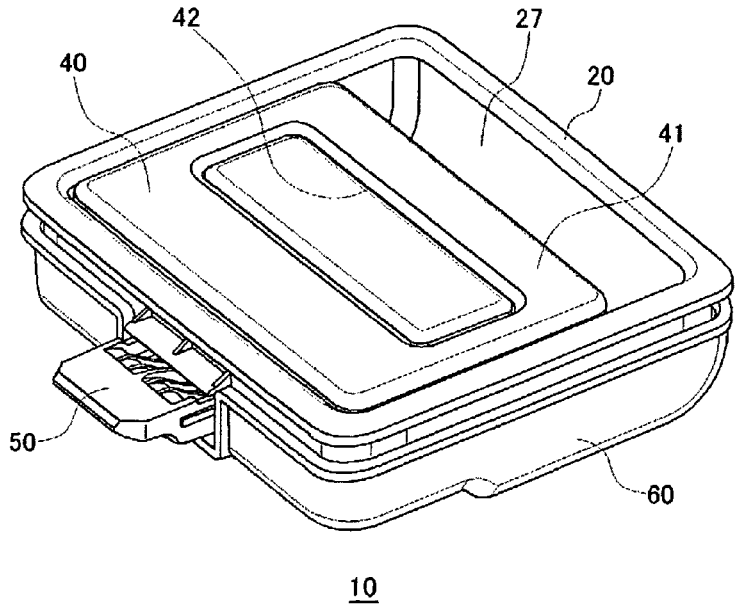
FIG. 2 illustrates a front surface side of a handle system according to the embodiment.
Figure 3:
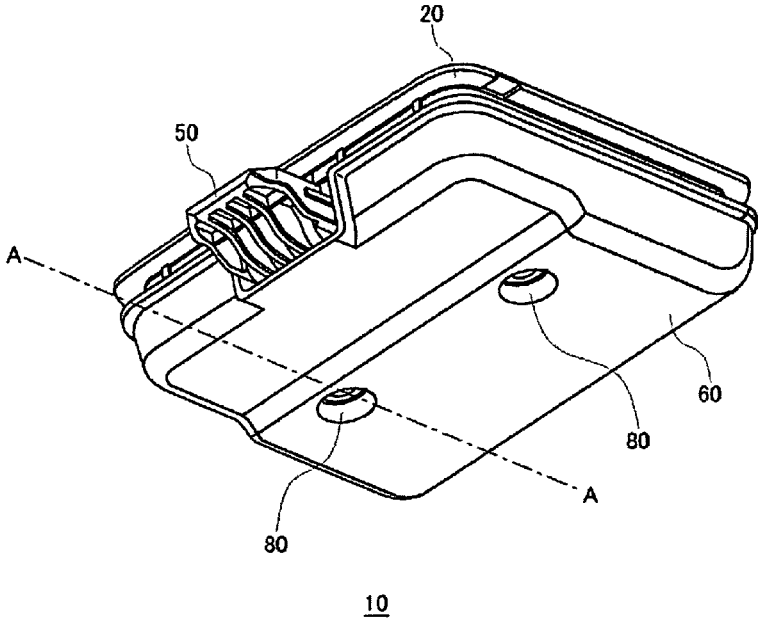
FIG. 3 illustrates a back surface side of the handle system.
Figure 4:
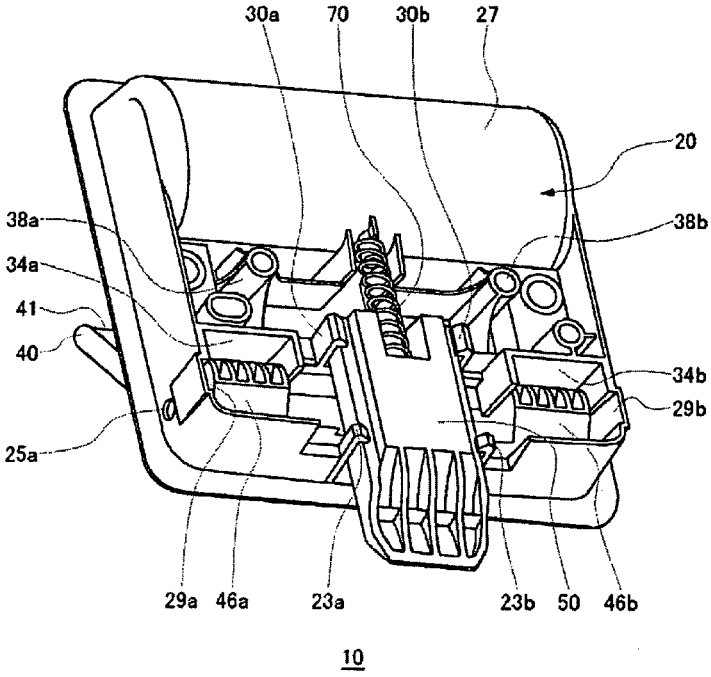
FIG. 4 illustrates the handle system without a cover.

FIG. 2 illustrates a front surface side of the handle system 10 according to the embodiment. FIG. 3 illustrates a back surface side of the handle system 10. And, FIG. 4 illustrates the back surface side of the handle system 10 from which a cover 60 is removed. Like reference numerals will be given to similar or like components or members which are shown in the individual drawings, and the repetition of the same description will be omitted.

The handle system 10 includes a main body 20, an operating member 40, a lock member 50, the cover 60 and a coil spring 70. The main body 20 and the operating portion 40 are positioned on the front surface side, while the cover 60 is positioned on the back surface side of the handle system 10. As shown in FIG. 3, the cover 60 covers a back surface of the main body 20.

The main body 20 and the cover 60 form an exit/entrance therebetween, and the lock member 50 is provided so as to project from the exit/entrance with a certain distance, thereby locking the board 1 to the lock receiver in the luggage compartment. In the handle system 10, a direction in which the lock member 50 projects is referred to a front direction, whereas a direction in which the lock member 50 retreats is referred to as a rear direction.

Figure 5:
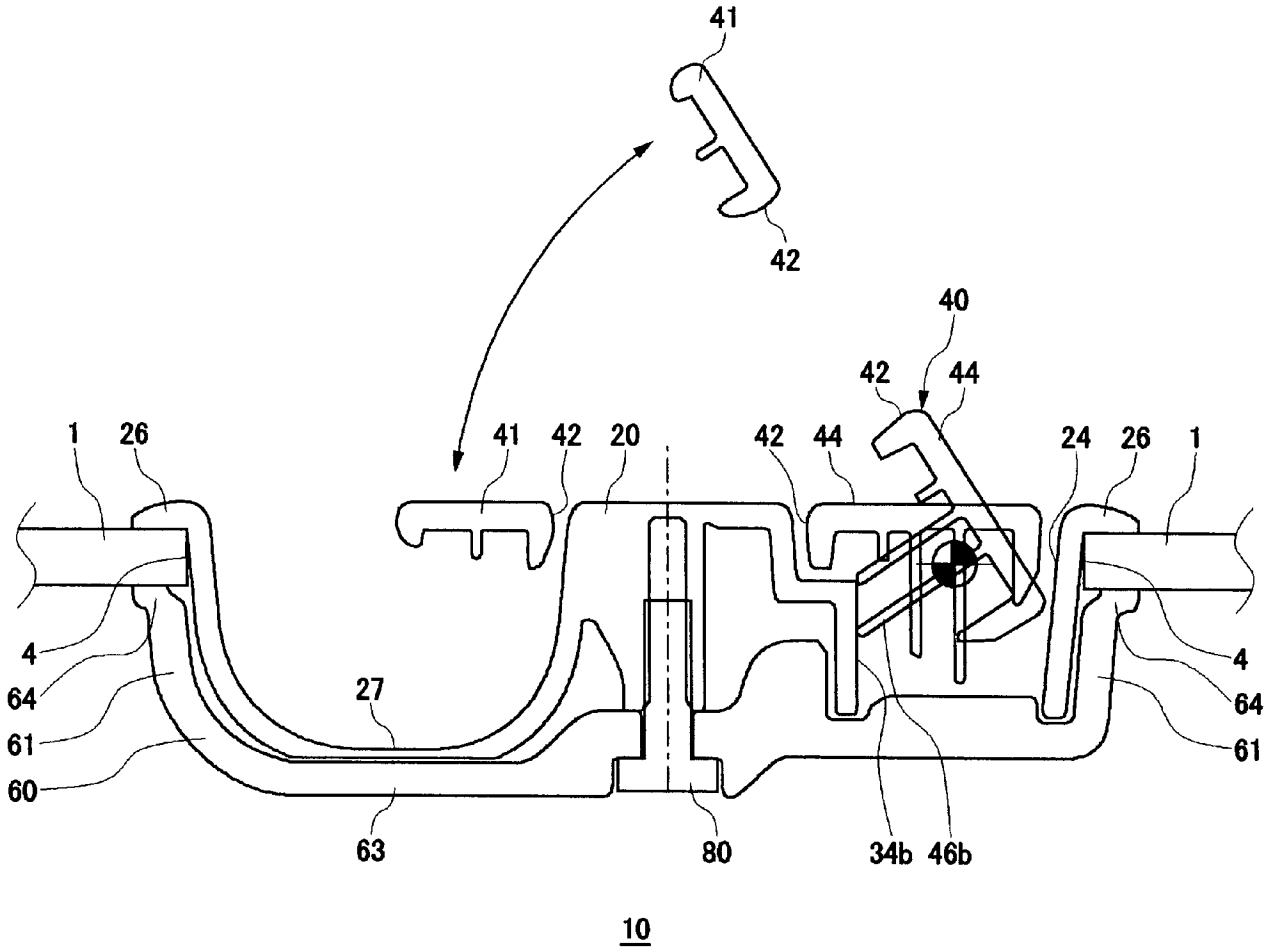
FIG. 5 cross-sectionally illustrates the handle system shown in FIG. 3 along the line A-A.

FIG. 5 cross-sectionally illustrates the handle system 10 shown in FIG. 3 along the line A-A. The board 1 has a mounting hole 4. The handle system 10 is mounted on the board 1 by sandwiching the edge of the mounting hole 4 with a circumferential flange 26 of the main body 20 and a circumferential flange 64 of the cover 60 and by fixing the cover 60 and the main body 20 together with screws 80. The whole of the back surface of the main body 20 is covered by the cover 60.

The operating member 40 is rotatably supported on the main body 20 so as to be operated from a front surface side of the main body 20. For example, the user inserts the hand under a gripping portion 41 of the operating member 40, and pulls up the gripping portion 41 with the fingertip so as to rotate it slightly. Subsequently, the user holds the gripping portion 41 having been pulled out of the main body 20 with the hand firmly. And then, the user pulls the operating member 40 upwards so as to unlock the board 1, and lifts up the board 1 while holding the gripping portion 41.

As shown in FIG. 4, except for the cover 60, the operating member 40, the lock member 50 and the coil spring 70 are assembled to the main body 20. Thus, by appropriately adjusting a distance between the circumferential portion 64 and a bottom portion 63 of the cover 60, that is, a height of a circumferential wall 61 of the cover 60, the handle system 10 can be adapted to a board with a different specification which has a different thickness without modifying the other components.

Referring to FIGS. 2 to 5, the individual members will be described specifically.

Figure 6:
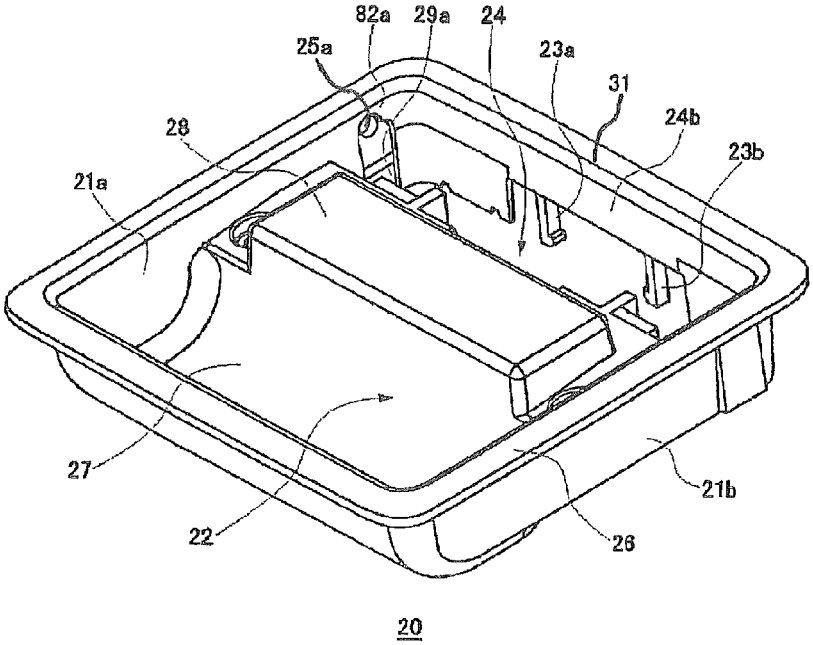
FIG. 6 illustrates a front surface side of a main body.
Figure 7:
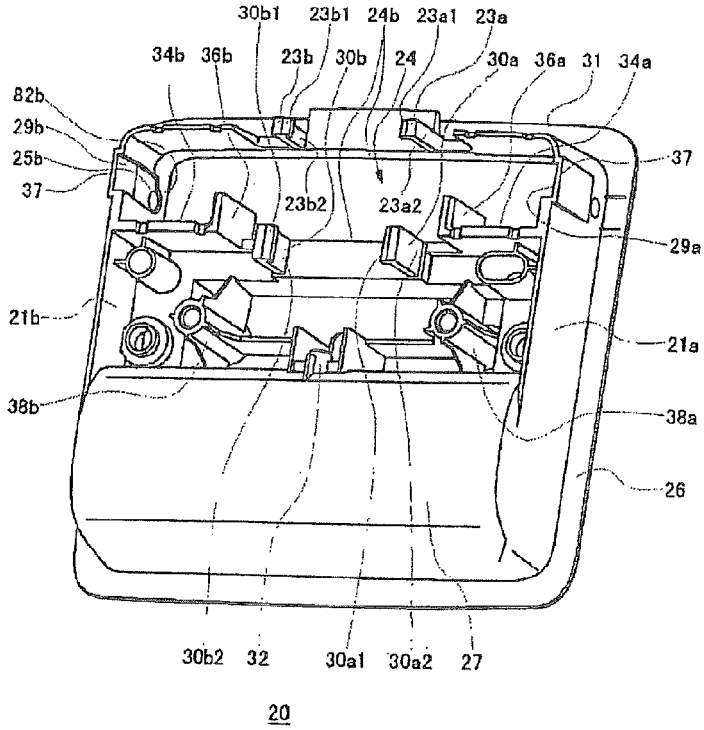
FIG. 7 illustrates a back surface side of the main body.

FIG. 6 illustrates the front surface side of the main body 20 according to the embodiment. FIG. 7 illustrates the back surface side of the main body 20. The main body 20 has a first side wall 21*a* and a second side wall 21*b* (these may be correctively referred to as "side walls 21"), a base portion 22, a front edge 31, a through hole 24 and the circumferential flange 26.

The first side wall 21*a* and the second side wall 21*b* face with each other. A first shaft hole 25*a* and a first tapered portion 29*a* are formed in the first side wall 21*a*, while a second shaft hole 25*b* and a second tapered portion 29*b* are formed in the second side wall 21*b*. The first shaft hole 25*a* and the first tapered portion 29*a* are disposed so as to face the second shaft hole 25*b* and the second tapered portion 29*b*, respectively. A distance between the first tapered portion 29*a* and the second tapered portion 29*b* (these may be correctively referred to as "tapered portions 29") gets wider as the first tapered portion 29*a* and the second tapered portion 29*b* extend from the first shaft hole 25*a* and the second shaft hole 26*b* towards respective back end portions thereof. The thickness of the tapered portion 29 gets thinner as it extends from the first shaft hole 25 towards the base portion 63 of the cover 60. Surface walls 82*a*, 82*b* around the shaft holes 25 are thicker than the back side tapered portions 29 and project much further inwards than the tapered portions 29. According to the above configuration, projecting shafts 43 of the operating member 40 can be prevented from being removed from the shaft holes 25 when the operating member 40 is pulled upwards.

The front edge 31 connects the side walls 21 at both ends thereof. The lock member 50 enters into and exits from the main body 20 via the front edge 31.

The base portion 22 is positioned between the first side wall 21*a* and the second side wall 21*b*. The base portion 22 has a pair of second elastic claws 30*a*, 30*b* (these may be correctively referred to as "second elastic claws 30"), an operation guide portion 27 which is formed into a U-shape, and a central bulge 28 which is continuous with the operation guide portion 27. A screw boss 38*a* and a screw boss 38*b* are erected from the base portion 22.

First elastic claws 23*a*, 23*b* (these may be collectively referred to as "first claws 23") are erected at the front edge 31, while the second elastic claws 30 are erected at the base portion 22. A height of distal ends of the first claws 23 is the same as a height of distal ends of the second elastic claws 30. The first elastic claws 23 and the second elastic claws 30 are positioned across the through hole 24 at front and rear hole edges thereof, respectively. The lock member 50 is supported slidably at the front and rear thereof by the first elastic claws 23 and the second elastic claws 30, whereby the lock member 50 can be supported stably. The first elastic claws 23*a*, 23*b* have first pillar portions 23*a*2, 23*b*2 and first claw portions 23*a*1, 23*b*1 which project from the first pillar portions 23*a*2, 23*b*2, respectively. And, the second elastic claws 30*a*, 30*b* have second pillar portions 30*a*2, 30*b*2 and second claw portions 30*a*1, 30*b*1 which project from the second pillar portions 30*a*2, 30*b*2, respectively. The first claw portions 23*a*1, 23*b*1 and the second claw portions 30*a*1, 30*b*1 (these may be collectively referred to as "claw portions") project in directions in which they face each other. A narrowest distance defined between the pair of claw portions is narrower than the width of the lock member 50. The width of the lock member 50 means a distance defined between side surfaces of the lock member 50.

The central bulge 28 is accommodated in an opening 42 in the operating member 40 so that a front surface of the handle system 10 is flat together with the circumferential flange 26 and the operating member 40. A first projection 34*a* and a second projection 34*b*, which both have a wall shape, are formed on a back surface side of the central bulge 28. A spring receiving portion 32 is formed on the base portion 22, and one end of the coil spring 70 is held thereat.

The first projection 34*a* and the second projection 34*b* are at right angles to the side walls 21 and are disposed so as to lie adjacent to the through hole 24 while facing each other. A first wall 36*a* and a second wall 36*b* are connected with the first projection 34*a* and the second projection 34*b*, respectively, at right angles so as to extend towards the front edge 31.

The through hole 24 is disposed between the base portion 22 and the front edge 31 and also between the pair of shaft holes 25. The through hole 24 functions as an insertion hole when the operating member 40 is assembled to the main body 20. A hole edge 24*b* is provided around the through hole 24. The operating member 40 is inserted into the through hole 24 from the back surface side of the main body 20.

Figure 8:
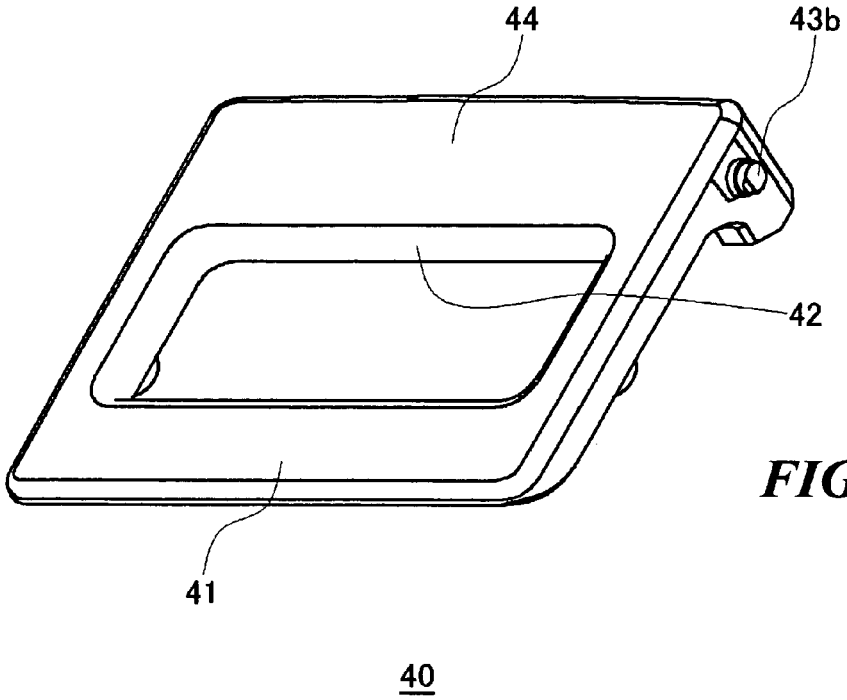
FIG. 8 illustrates a front surface side of an operating member.
Figure 9:
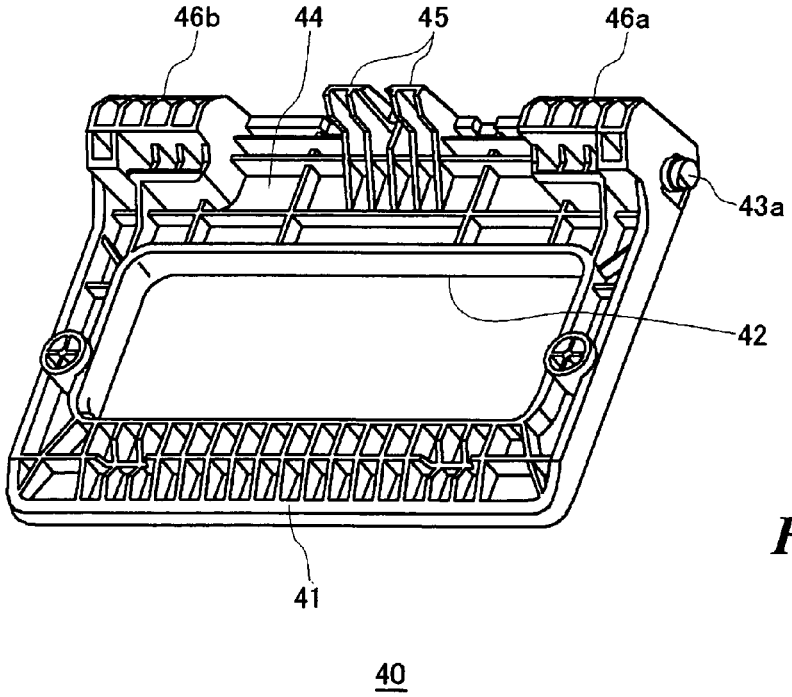
FIG. 9 illustrates a back surface side of the operating member.

FIG. 8 illustrates a front surface side of the operating member 40 according to the embodiment. FIG. 9 illustrates a back surface side of the operating member 40. The operating member 40 has the gripping portion 41, the opening 42, the projecting shafts 43 and a connecting portion 44. The user can insert the hand into the opening 42 to hold the gripping portion 41. The gripping portion 41 and the connecting portion 44 are disposed parallel so as to face each other across the opening 42.

A first projecting shaft 43*a* and a second projecting shaft 43*b* (these may be correctively referred to as "projecting shafts 43") project in directions in which they move away from each other so as to be inserted into the corresponding shaft holes 25. A distance defined between a distal end of the first projecting shaft 43*a* and a distal end of the second projecting shaft 43*b* may be narrower than a distance defined between an end (the back end portion 37) of the first tapered portion 29*a* and an end (the back end portion 37) of the second tapered portion 29*b*. According to the above configuration, the projecting shafts 43 can be inserted into the shaft holes 25 smoothly. The connecting portion 44 is provided between the projecting shafts 43, so as to connect the projecting shafts 43 together strongly and firmly.

An acting piece 45 is formed centrally on a back surface side of the connecting portion 44 so as to project therefrom. The acting piece 45 moves the lock member 50 to the rear in accordance with a rotation of the operating member 40. A first stopper 46*a* and a second stopper 46*b* (these may be correctively referred to as "stoppers 46") are formed on the back surface side of the connecting portion 44 so as to project therefrom with the acting piece 45 positioned therebetween. As shown in FIG. 5, when the operating member 40 is rotated in an unlocking direction, the stoppers 46 are brought into abutment with the first projection 34*a* and the second projection 34*b* on the main body 20, whereby a further rotation of the operating member 40 is restricted.

Figure 10A:
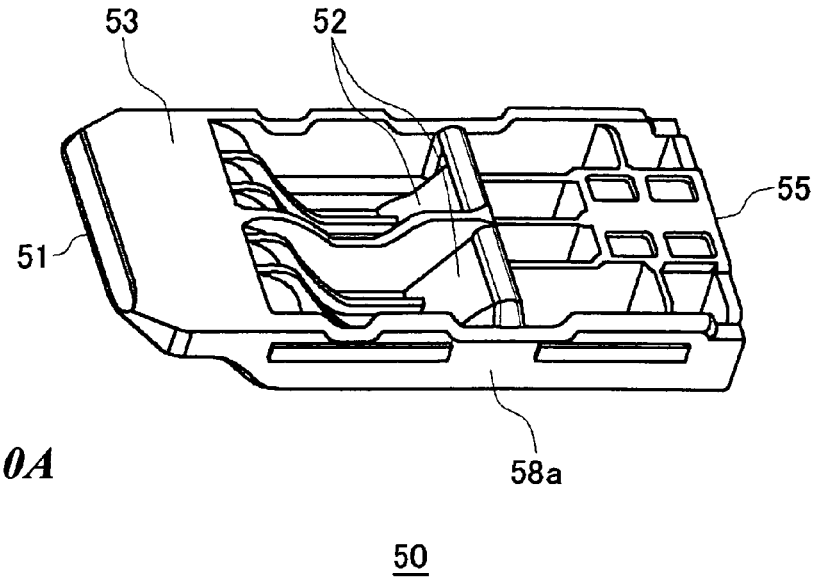
FIG. 10A illustrates a front surface side of a lock member.
Figure 10B:
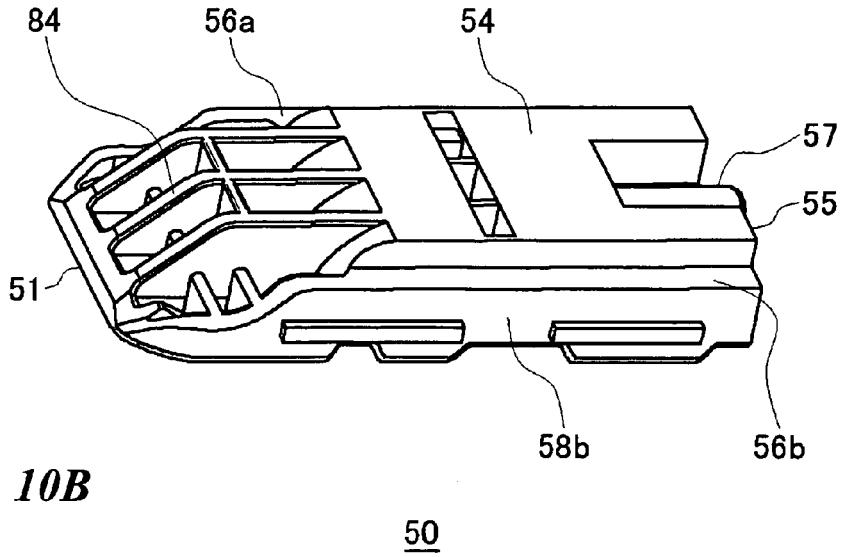
FIG. 10B illustrates a back surface side of the lock member.

FIG. 10A illustrates a front surface side of the lock member 50, and FIG. 10B illustrates a back surface side of the lock member 50, according to the embodiment. The lock member 50 has a rectangular shape. A distal end portion 51 of the lock member 50 enters and exits from the lock receiver. A spring support portion 57 is formed at a rear end portion 55 of the lock member 50 so as to support one end of the coil spring 70.

Acted portions 52 are formed in a front surface 53 of the lock member 50 so as to be recessed from the front surface 53. When the operating member 40 is operated in the unlocking direction, the acted portions 52 receive a rearward force from the acting piece 45 to thereby move the lock member 50 to the rear.

A first recess 56*a* and a second recess 56*b* (these may be correctively referred to as "recesses 56") are formed in corners of side surfaces 58*a*, 58*b* on the back surface side of the lock member 50 so as to extend along a moving direction of the lock member 50. The recesses 56 constitute surfaces which are lowered further downwards than a back surface of the lock member 50. As shown in FIG. 4, the claw portions of the first elastic claws 23 and the second elastic claws 30 project into the recesses 56. The claw portions may be or may not be in contact with the recesses 56 at all times after assemblage. According to the above configuration, the lock member 50 is restricted from moving towards the cover 60 side. A narrowest distance defined between the pair of claw portions is wider than the width of the back surface 54 but is narrower than a distance defined between the side surface 58*a* and the side surface 58*b*. A front end taper 84 is formed at a front end portion on the back surface of the lock member 50 so that the thickness of the front end taper 84 gets thinner as it extends towards a distal end thereof. When the front end taper 84 receives a downward force, a force to move the lock member 50 into the main body 20 is generated, thereby accommodating the lock member 50 into the main body 20 against the coil spring 70.

Figure 11:
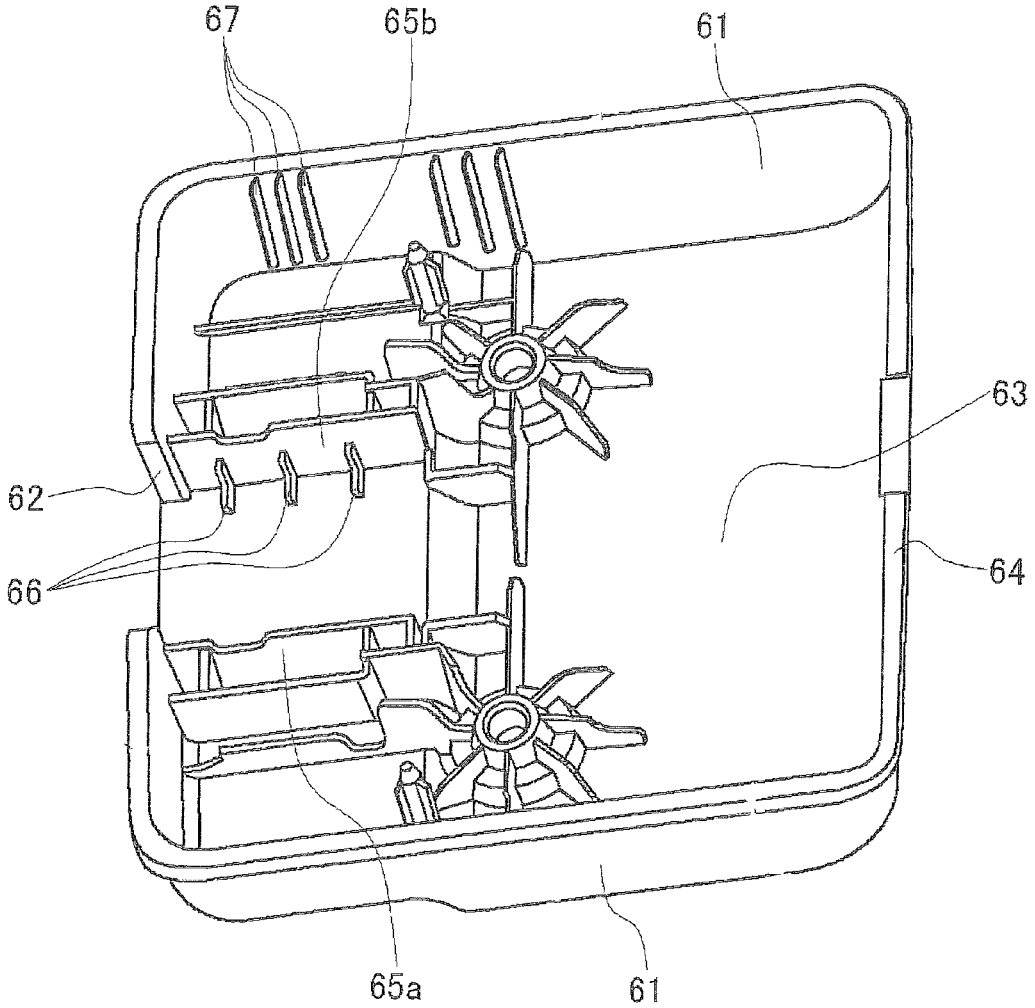
FIG. 11 illustrates a front surface side of a cover.

FIG. 11 illustrates a front surface side of the cover 60 according to the embodiment. The cover 60 has the bottom portion 63 and the circumferential wall 61 which is erected from the periphery of the bottom portion 63. An exit/entrance 62 is formed in a front side of the circumferential wall 61 so that the lock member 50 projects therefrom. The circumferential flange 64 is formed along an end of the circumferential wall 61.

A first opening suppressing portion 65*a* and a second opening suppressing portion 65*b* (these may be correctively referred to as "opening suppressing portions 65") are formed so as to extend to the rear from the exit/entrance 62. The opening suppressing portions 65 project into a wall shape from the bottom portion 63. In an assembled state, the lock member 50 is accommodated between the first opening suppressing portion 65*a* and the second opening suppressing portion 65*b*. As this occurs, the opening suppressing portions 65 are brought into abutment with or closely face outsides of the first elastic claws 23 and the second elastic claws 30. According to the above configuration, the opening suppressing portions 65 can suppress the movement of the elastic claws 23, 30 in an opening direction when vibrations of the vehicle are transmitted to the lock member 50. The opening direction means a direction towards the first side wall 21*a* with respect to the first elastic claw 23*a* and the second elastic claw 30*a* and a direction towards the second wall 21*b* with respect to the first elastic claw 23*b* and the second elastic claw 30*b*. The opening suppressing portions 65 may be or may not be in contact with the first elastic claws 23 and the second elastic claw 30 at all times after the cover 60 has been assembled to the main body 20. Namely, a distance defined between the first opening suppressing portion 65*a* and the second opening suppressing portion 65*b* may be wider than a distance defined between surfaces of the first elastic claws 23 which face the corresponding opening suppressing portions 65.

Lock member restricting portions 66 are formed at roots of the opening suppressing portions 65 into a step-like fashion so as to match the shape of the recesses 56 in the lock member 50. After the cover 60 is assembled to the main body 20, the projecting step-like lock member restricting portions 66 are accommodated in the recessed step-like recesses 56. The lock member restricting portions 66 restrict the lock member 50 from moving towards the cover 60 side. According to the above configuration, the movement of the lock member 50 can be restricted when vibrations of the vehicle are transmitted to the lock member 50, thereby preventing the removal of the lock member 50 from the main body 20. After the cover 60 is assembled to the main body 20, the lock member restricting portions 66 may not be in contact with the lock member 50 at all times, and a shortest distance between the facing lock member restricting portions 66 may be longer than the width of the back surface 54 of the lock member 50. According to the above configuration, the lock member 50 is allowed to slide smoothly.

Deformation suppressing portions 67 are formed on an inner side of the circumferential wall 61 so as to project therefrom. In this embodiment, the deformation suppressing portions 67 are formed as three ribs. The deformation suppressing portions 67 are disposed on outer sides of the tapered portions 29 after the cover 60 is assembled to the main body 20 so as to close face the outer sides of the tapered portions 29. The deformation suppressing portions 67 suppress the outward deformation of the tapered portions so that the distance defined between the first shaft hole 25*a* and the second shaft hole 25*b* is not extended. Thus, the possibility that the projecting shafts 43 are removed from the shaft holes 25 can be reduced. The deformation suppressing portions 67 may not be in contact with the tapered portions 29 at all times after the cover 60 is assembled to the main body 20. Alternatively, the deformation suppressing portions 67 may be pressed against the tapered portions 29 so as to be in contact therewith at all times after the assemblage of the cover 60 to the main body 20. By bringing the deformation suppressing portions 67 into abutment with the tapered portion 29 after the assemblage, the rigidity of the tapered portions 29 can be increased, and the projecting shafts 43 can be surely prevented from being removed from the corresponding shaft holes 25.

When lifting up the board 1 by using the handle system 10, since the gripping portion 41 is pulled, a load is applied to he tapered portions 29 via the projecting shafts 43. If the tapered portions 29 are formed thinner than the walls surrounding them, the tapered portions 29 may be deformed due to the load applied thereto. In particular, if the tapered portions 29 and portions of the side walls 21 therearound are deformed outwards, the projecting shafts 43 may be removed from the corresponding shaft holes 25. In this embodiment, since the outward deformation of the tapered portions 29 are suppressed by the deformation suppressing portions 67, the projecting shafts 43 can be surely prevented from being removed from the corresponding shaft holes 25.

Figure 12A:
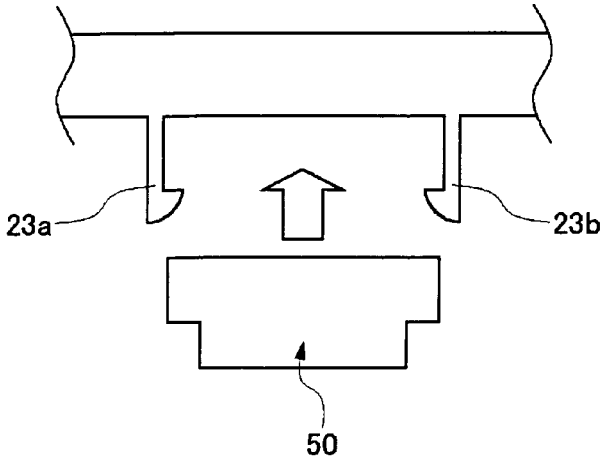
FIGS. 12A to 12C illustrate an assemblage of the lock member to the main body.
Figure 12B:
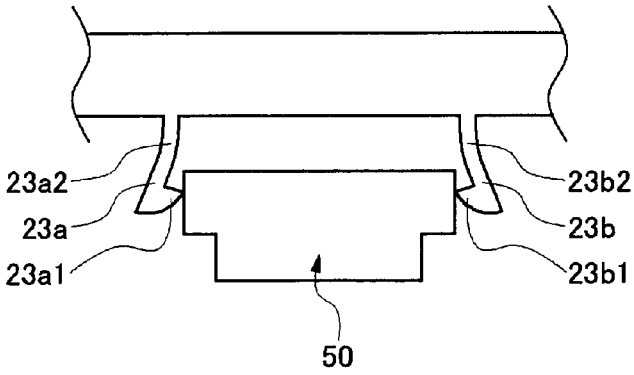
Figure 12C:
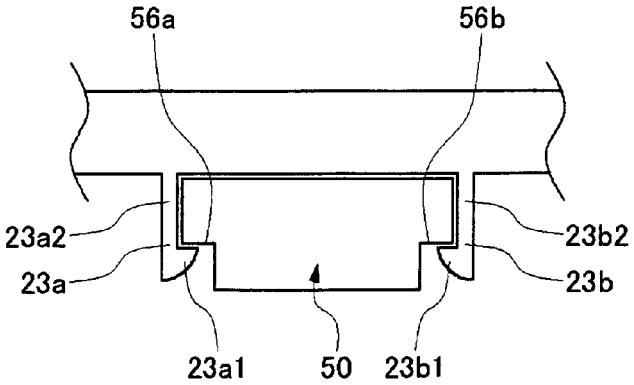

FIGS. 12A to 12C illustrate an assemblage of the lock member 50 to the main body 20, according to the embodiment. While FIGS. 12A to 12C illustrate an engagement of the lock member 50 and the first elastic claws 23, an engagement of the lock member 50 with the second elastic claws 30 is similar thereto. As shown in FIG. 12A, for example, the user grips on the lock member 50, and the lock member 50 is moved towards a space between the first elastic claw 23*a* and the first elastic claw 23*b*.

As shown in FIG. 12B, the pair of first elastic claws 23 are opened from their initial postures when the lock member 50 is assembled to the main body 20. Specifically, side surfaces of the lock member 50 are brought into the first claw portions 23*a*1, 23*b*1 of the first elastic claws 23 to press them in the opening direction, whereby the first elastic claws 23 are opened. Then, as shown in FIG. 12C, the first elastic claws 23 receive the lock member 50, and the first elastic claws 23 are elastically restored to their initial postures. Since the space between the first elastic claws 23 is expandable, the lock member 50 can easily be assembled into the main body 20. After the lock member 50 has been assembled, even when the lock member 50 attempts to move in a direction in which it is removed from the main body 20, the first claw portions 23*a*1, 23*b*1 of the first elastic claws 23 are caught on the lock member 50, thereby restricting such a movement of the lock member 50.

Figure 13A:
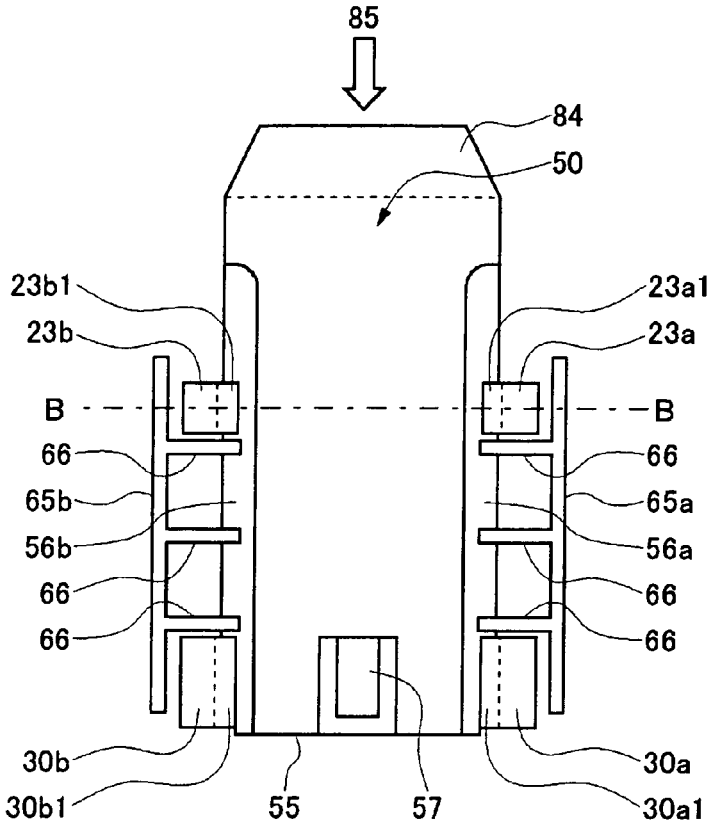
FIGS. 13A and 13B illustrate a positional relationship between the lock member, elastic claws and an opening suppressing portion.
Figure 13B:
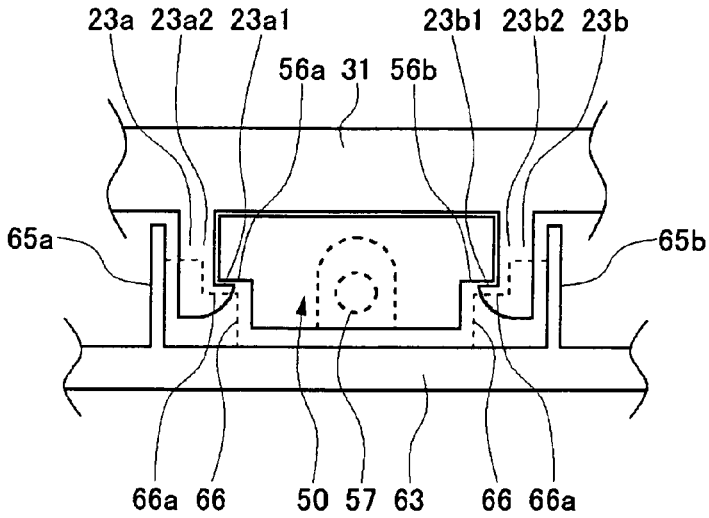

FIGS. 13A and 13B illustrate a positional relationship of the elastic claws 23, 30 and the opening suppressing portions 65, according to the embodiment. FIG. 13A illustrates the lock member 50 from the back surface side thereof, and FIG. 13B cross-sectionally illustrates the lock member 50 along the line B-B in FIG. 13A.

As shown in FIG. 13B, the first pillar portions 23*a*2, 23*b*2 of the first elastic claws 23 are erected along the side surfaces of the lock member 50. The first claw portions 23*a*1, 23*b*1 of the first elastic claws 23 enter spaces of the recesses 56 to closely face the recesses 56. The second elastic claws 30 similarly engage with the lock member 50. The lock member restricting portions 66 are indicated by dotted lines.

As shown in FIG. 13A, the first elastic claws 23*a*, 23*b* and the second elastic claws 30*a*, 30*b* are disposed at four locations which lie close to the side surfaces of the lock member 50. The lock member 50 is urged in a locking direction indicated by an arrow 85 and is kept projecting from the main body 20 and the board 1 when the lock member 50 is not operated. When the lock member 50 moves in a front-to-rear direction, the lock member 50 is guided by the first elastic claws 23 and the second elastic claws 30 so as not to move in a left-to-right direction which is at right angles to the front-to-rear direction.

When the operating member 40 is gripped to lower the board 1 to thereby close the storage box in the rear portion of the vehicle, a large load or impact is not applied to the lock member 50 since the lock member 50 is accommodated in the main body 20. On the other hand, when the board 1 falls naturally without operating the operating member 40, in a state where the lock member 50 is kept projecting from the main body 20, the front end taper 84 collides against an edge of the storage box.

The front end taper 84 of the lock member 50 collides against the edge of the storage box to receive an upward force, whereby a rotating moment is generated, and the rear of the lock member 50 attempts to rotate downwards. The second claw portions 30*a*1, 30*b*1 of the second elastic claws 30 which are situated at the rear of the lock member 50 are pressed downwards by the lock member 50 so as to open the second pillar portions 30*a*2, 30*b*2. However, even when they attempt to move in the opening direction, since the second pillar portions 30*a*2, 30*b*2 come into abutment with the corresponding opening suppressing portions 65*a*, 65*b*, the movement of the second pillar portions 30*a*2, 30*b*2 in the opening direction is suppressed strongly and firmly. The movement of the second pillar portions 30*a*2, 30*b*2 in the opening direction is also suppressed. Thus, the removal of the lock member 50 can be suppressed. Even when the rear of the lock member 50 moves the second claw portions 30*a*1, 30*b*1 in the opening direction so as to move downwards, the recesses 56 come into abutment with horizontal surfaces 66*a* of the lock member restricting portions 66 so as to restrict the movement of the lock member 50. Namely, the lock member restricting portions 66 restricts the downward movement of the lock member 50, even in a tough condition such as a condition where the first elastic claws 23 and the second elastic claws 30 wear by the aging and a condition where severe vibration is applied, and guide the movement of the lock member 50 in the front-to-rear direction.

The height of the horizontal surface 66*a* of the lock member restricting portion 66 has a certain dimensional tolerance with respect to the lock member 50. There are also variations in the thickness of the board 1, the height of the screw bosses 38*a*, 38*b* of the main body 20, the thickness of the base portion 20 and the thickness of the cover 60. As a result, the positional relationship of the lock member restricting portions 66 with respect to the lock member 50 may vary largely. Therefore, the height of the horizontal surfaces 66*a* is set so that the lock member restricting portions 66 are not in contact with the lock member 50 at all times and but are preferably brought into abutment with the lock member 50 only when a large load is applied to the lock member 50 or the lock member 50 attempts to move largely.

Figure 14A:
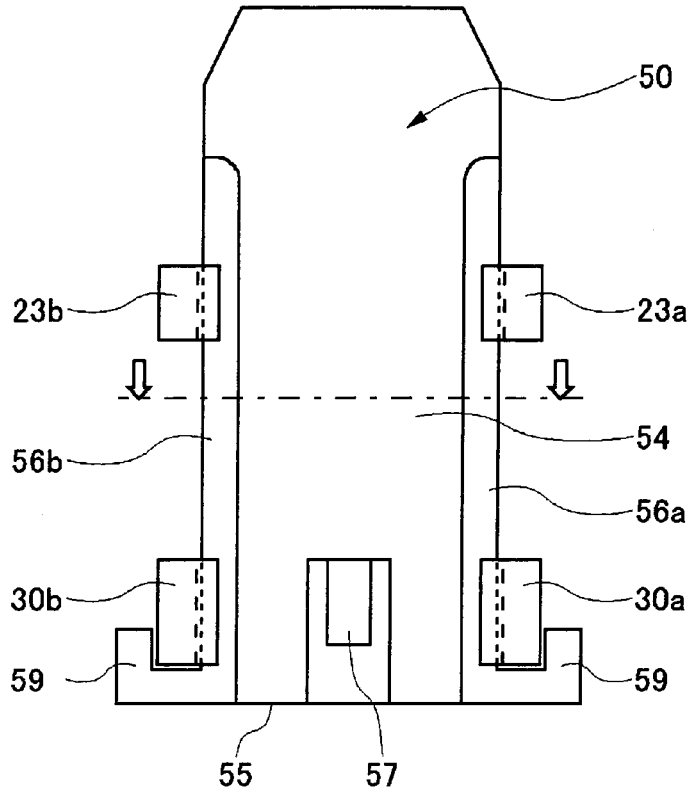
FIGS. 14A and 14B illustrate a modified example of the lock member.
Figure 14B:
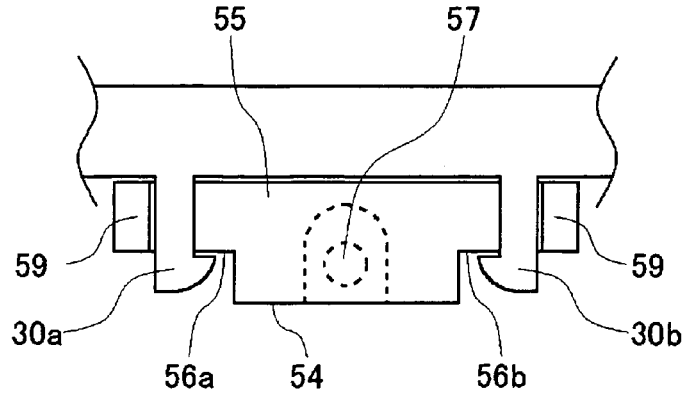

FIGS. 14A and 14B illustrate a modified example of a lock member 50 according to the embodiment. FIG. 14A illustrates the lock member 50 from a back surface side thereof, and FIG. 14B illustrates the lock member 50 from a rear side thereof. In FIGS. 14A and 14B, the first elastic claws 23 and the second elastic claws 30 are in a locking state.

The lock member 50 according to the modified example has hook portions 59 at a rear end portion 55 thereof. In a locking state, the hook portions 59 are caught on the second elastic claws 30 and extend from the rear end portion 55 to outer sides or opening sides of the second elastic claws 30. The hook portions 59 positioned on the outer sides of the second elastic claws 30 to closely face the second elastic claws 30, thereby suppressing the movement of the second elastic claws 30 in the opening direction and the removal of the lock member 50 from the second elastic claw 30 due to vibrations of the vehicle transmitted to the lock member 50.

As shown in FIG. 14B, distal ends and the claw portions of the second elastic claws 30 are formed so as not to extend beyond the back surface 54 to project to the back surface side of the lock member 50. If the recesses 56 are not provided, the claw portions of the second elastic claws 30 project to the back surface 54. In this case, the cover 60 and the lock member 50 need to be spaced by at least a distance equal to the height of the claw portions. Namely, by forming the recesses 56, the back surface 54 of the lock member 50 and the cover 60 can be made close, and the movement of the lock member 50 can be restricted. For example, since the back surface 54 of the lock member 50 is allowed to approach the cover 60, the lock member 50 can be formed thick to thereby provide a sufficient strength for the lock member 50.

Figure 15:
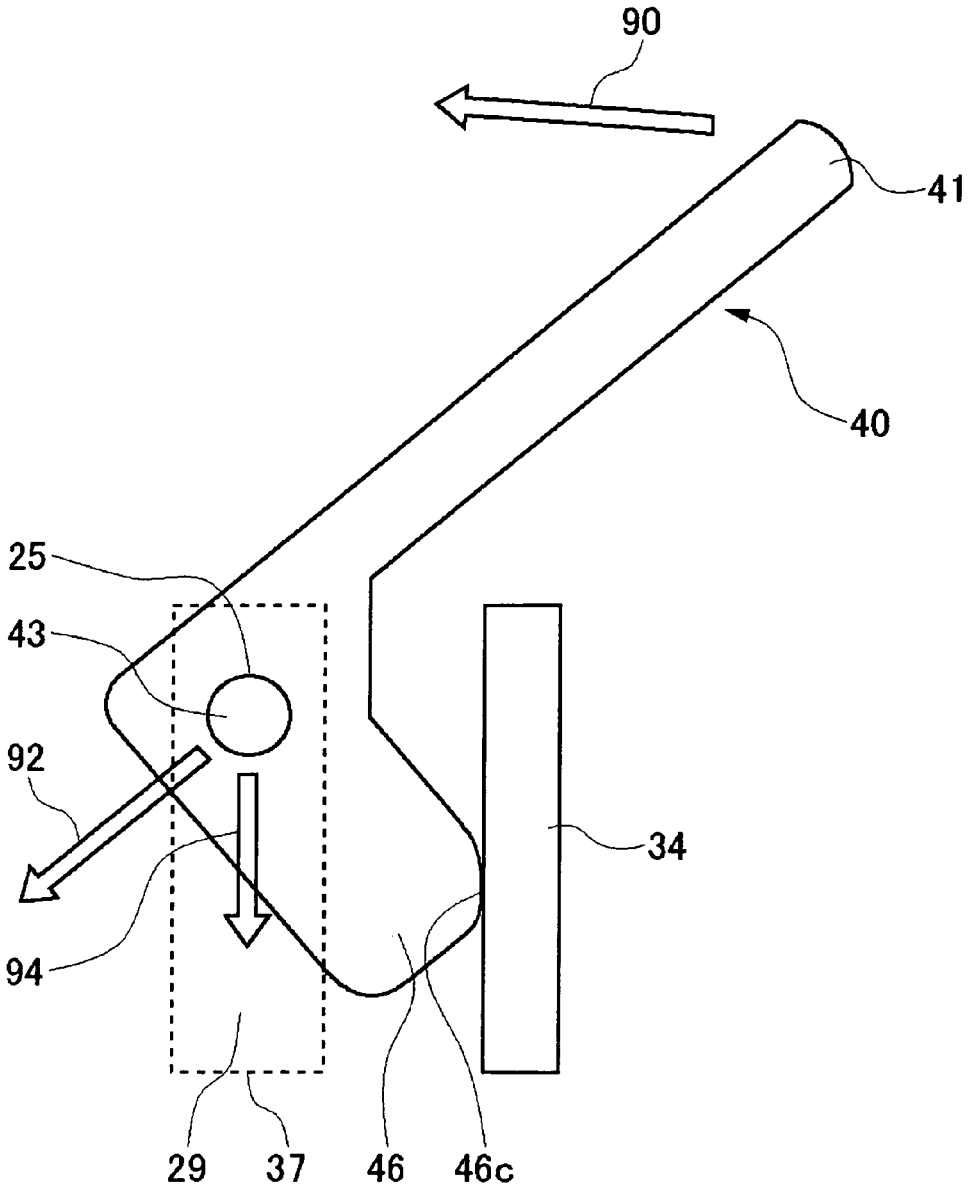
FIG. 15 illustrates a relationship between the operating member and the projections.

FIG. 15 illustrates a relationship between the operating member 40 and the projections 34, according to the embodiment. When the operating member 40 is operated, a counterclockwise operating force 90 is applied as shown in FIG. 15. The operating member 40 rotates about the projecting shafts 43 which function as rotational shafts, and the rotation of the operating member 40 is stopped when the stoppers 46 are brought into abutment with the projections 34 of the main body 20. As this occurs, if a force 94 directed straight to the back end portions 37 is applied to the projecting shafts 43, since the force 94 is applied in the same direction in which the thickness of the tapered portions 29 gets thinner, the projecting shafts 43 may be removed from the shaft holes 25 due to the structure of the tapered portions 29. Therefore, it is adjusted such that a shaft applied force 92 in a different direction from the direction of the force 94 is applied to the shaft holes 25 by the projecting shafts 43 when the stoppers 46 are in abutment with the projections 34. For example, the above-mentioned shaft applied force 92 can be obtained by adjusting at least a relationship between the positions of contact points 46*c* between the stoppers 46 and the projections 34 and the positions of the shaft holes 25. When the stoppers 46 are brought into surface contact with the projections 34, centers of the contact surfaces are defined as the contact points 46*c*. The shaft applied force 92 may be set to a direction rotated by 20 or more degrees from a direction of the force 94, that is, the direction in which the thickness of the tapered portions 29 gets thinner. According to the above configuration, the projecting shafts 43 can be surely prevented from being removed from the corresponding shaft holes 25.

The invention is not limited to the above-mentioned embodiment and its modified examples, and hence, modifications including various design changes can be made to the embodiment and its modified examples based on the knowledge of those skilled in the art to which the invention pertains. Embodiments which incorporate such modifications may be included in the scope of Claims.

The invention claimed is:

1. A handle system which is mounted in a board which is placed in a vehicle's luggage compartment, the handle system comprising:

a main body which is configured to be mounted to a mounting hole in the board and which comprises:

a pair of side walls in which a pair of shaft holes are formed, respectively, a base portion which is positioned between the side walls;

a front edge which connects the side walls;

a through hole which is defined by the side walls, the base portion and the front edge; and a pair of elastic claws which project from a back surface of the front edge, each of the elastic claws having a pillar portion projecting downwards from the back surface of the front edge and a claw portion projecting inwards from a corresponding one of the elastic claws;

an operating member which comprises:

a gripping portion which is configured to be gripped by a user, an entire width of the gripping portion being smaller than a width of the through hole such that the gripping portion is configured to pass through the through hole from a back surface side to a front surface side of the main body; and a pair of projecting shafts which project outwards from both sides of the operating member, respectively, a distance between tip ends of the projecting shafts being greater than the width of the through hole so that the projecting shafts enter the shaft holes of the side walls to thereby allow the operating member to be rotatably assembled to the main body; and a lock member which causes the board to be locked to or to be unlocked from a lock receiver in the luggage compartment in accordance with a rotation of the operating member, a width of the lock member being greater than a distance between the claw portions of the elastic claws and being smaller than a distance between the pillar portions of the elastic claws so that the lock member enters between the elastic claws by elastically pushing the claw portions outwards and being configured to be slidably held between the pillar portions.

2. The system of claim 1, further comprising:

a cover which is attached to the main body to cover the back surface side thereof, wherein the lock member comprises recesses in side surfaces thereof to extend in a direction in which the lock member slides, and the claw portions of the elastic claws project into the recesses, wherein the cover comprises:

a bottom portion;

opening suppressing portions which project form the bottom portion and which contact or closely face the elastic claws, respectively, to thereby suppress an outward movement of the elastic claws; and L-shaped restricting portions which project from the bottom portion and which contact or closely face the recesses of the lock member along their L-shapes, respectively, to thereby restrict a movement of the lock member towards the cover and towards each of the side walls.

3. The system of claim 1, wherein a rear end portion of the lock member comprises hook portions, and wherein the hook portions hook the elastic claws and extend along openable sides of the elastic claws so as to closely face the elastic claws in a locking state.

4. The system of claim 1, wherein the main body further comprises a second pair of elastic claws provided on a back surface of the base portion, and the pair of elastic claws face the second pair of elastic claws, respectively, across the through hole.

5. A handle system which is mounted in a board which is placed in a vehicle's luggage compartment, the handle system comprising:

a main body which is mounted to a mounting hole in the board;

an operating member which is supported rotatably on the main body so as to be operated from a front surface side of the main body;

a lock member which locks the board to a lock receiver in the luggage compartment and which unlocks the board from the lock receiver when the operating member is rotated; and a cover which is adapted to cover a back surface side of the main body, wherein the main body comprises:

a pair of side walls in which a pair of shaft holes are formed, respectively];

a base portion which is positioned between the side walls;

a pair of elastic claws which are provided on the base portion, and the pair of elastic claws are configured to allow the lock member to elastically push the pair of elastic claws outwardly and to movably hold the lock member therebetween; there between, a front edge which connects the side walls; and a through hole which is disposed between the base portion and the front edge, wherein the operating member comprises a pair of projecting shafts which are inserted into the pair of shaft holes, respectively, wherein the side walls comprise tapered portions which face each other such that a distance therebetween there between gets wider as the tapered portions extend from the shaft holes towards back end portions of the side walls, and wherein the cover comprises deformation suppressing portions which are disposed on outer sides of the tapered portions so as to suppress outward deformations of the tapered portions, wherein the operating member comprises a gripping portion which is configured to be gripped by a user, and wherein the through hole is configured so as to receive the gripping portion of the operating member therethrough, and a width of the through hole being greater than an entire width of the gripping portion of the operating member.

6. The system of claim 5, wherein the cover comprises a circumferential wall which covers the side walls, and wherein the deformation suppressing portions project from the circumferential wall towards the tapered portions.

7. The system of claim 1, wherein the side walls of the main body comprise:

a pair of tapered portions which are formed around the shaft holes, respectively, a distance between the tapered portions becoming wider as they extend in a direction from the front surface side to the back surface side of the main body, and wherein the cover further comprises:

a circumferential wall which covers outer surfaces of the side walls when the cover is attached to the main body; and deformation suppressing portions which project from an inner surface of the circumferential wall so as to contact or closely face outer surfaces of the tapered portions when the cover is attached to the main body.

* * * * *